US006405915B1

(12) United States Patent
Backenstoes et al.

(10) Patent No.: US 6,405,915 B1
(45) Date of Patent: Jun. 18, 2002

(54) FEED MECHANISM FOR A MACHINE

(75) Inventors: Thomas E. Backenstoes; Neil E. Deming, both of Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/607,105

(22) Filed: Jun. 29, 2000

(51) Int. Cl.[7] ..... B65H 20/18

(52) U.S. Cl. ..... 226/141; 226/139; 226/158; 226/162; 226/163; 226/164

(58) Field of Search ..... 226/139, 141, 226/158, 162, 163, 164

(56) References Cited

U.S. PATENT DOCUMENTS

| | | | | | |
|---|---|---|---|---|---|
| 3,735,907 | A | * | 5/1973 | Kuchar et al. | 226/162 X |
| 3,846,997 | A | * | 11/1974 | Leis | 226/162 X |
| 4,478,360 | A | * | 10/1984 | Patkos | 226/163 |
| 4,501,065 | A | | 2/1985 | Zemek et al. | 29/845 |
| 4,580,710 | A | * | 4/1986 | Ledgerwood | 226/141 |
| 4,634,034 | A | * | 1/1987 | Kato | 226/158 X |
| 6,092,709 | A | * | 7/2000 | Schoenbeck et al. | 226/158 X |

* cited by examiner

*Primary Examiner*—Michael R. Mansen
*Assistant Examiner*—Minh-Chau Pham

(57) ABSTRACT

A machine (70) for receiving a continuous strip (10) of elongated products (12) mutually attached end to end includes a frame (82) and is arranged for incrementally feeding the strip of products and performing a manufacturing operation therewith. Each two adjacent products (12) are attached at an indentation (14). The machine include a feed mechanism (90) for incrementally feeding the strip of products. The feed mechanism includes first and second feed fingers (216, 218) mutually opposed on opposite sides of a feed track (108). The first and second feed fingers are movable toward the strip of product until in feeding engagement therewith without gripping the strip of products. The feed mechanism includes a drive carriage (94) and a follower carriage (96) arranged for independent sliding movement along the direction of feed and return. The feed track extends through both the drive carriage and follower carriage to guide the strip of product. The first and second feed fingers are carried by the drive carriage and coupled to the follower carriage so that relative motion of the drive carriage toward the follower carriage in the feed direction causes the feed fingers to mutually move into feeding engagement with the strip of products for effecting the incremental feeding thereof without gripping the strip of products.

20 Claims, 8 Drawing Sheets

FEED MECHANISM FOR A MACHINE

The present invention relates to a machine for receiving elongated products mutually attached end to end to form a continuous string of products and performing a manufacturing operation with one or more of the individual products, and more particularly to a feed mechanism for incrementally feeding the string of products.

BACKGROUND OF THE INVENTION

Machines for handling continuous strips of elongated products that are mutually attached end to end must be able to intermittently engage and advance each individual product into precise alignment for performing some manufacturing operation without regard to tolerance buildup caused by dimensional variations of the individual pieces of the strip. Typical examples of elongated products that are mutually attached end to end are square wire pins, shown in FIG. 1, and round wire pins, shown in FIG. 2. While the teachings of the present invention can be advantageously applied to the manufacture and use of other elongated products, for simplicity and to promote a more clear and better understanding of the present invention the following description of the invention will be limited to the elongated products shown in FIGS. 1 and 2. However, it is intended that the scope of the invention will include other elongated products as well. There is show in FIG. 1 a strip 10 of individual elongated pins 12, adjacent pins of which are interconnected or attached end to end at indentations 14. The strip 10 of pins is made of square wire so that the pins 12 have a square cross section. Each indentation includes angled surfaces 16 and 18 that are formed on the two adjacent pins, as shown. Similarly, there is shown in FIG. 2 a strip 20 of individual elongated pins 22, adjacent pins of which are interconnected or attached end to end at indentations 24. The strip 20 of pins is made of round wire so that the pins 22 have a round cross section. Each indentation includes angled surfaces 26 and 28 that are formed on the two adjacent pins, as shown. A portion 40 of a prior art feed mechanism is shown in FIG. 3, and includes a block 42 having a track 44 formed therethrough containing and guiding a strip 10 of pins 12. A feed pawl 46 is pivotally attached within a cutout 48 in the block by means of a pivot pin 50. The feed pawl 46 is urged by a spring 52 to pivot clockwise, as viewed in FIG. 3, so that a point 54 engages an indentation 14 of the strip 10, as shown. As the block is moved in the feed direction indicated by the arrow 56, by a mechanism not shown, the point 54 is pressed firmly into the indentation forcing the strip 10 against the opposite wall of the track 44 so that the strip 10 must move along with the block. After the end of the feed stroke is reached the strip 10 is held in place, by a mechanism not shown, while the block is moved in the return direction indicated by the arrow 58. This movement requires that the point 54 cam out of the indentation 14 and ride along the outer surface of the pin 12 until it reaches the next upper indentation, when the feeding process can be repeated. However, a potential problem arises in that, as the point 54 rides along the surface of the pin 12 it may scratch or otherwise mar the pin. Another potential problem with this prior art mechanism is that the block necessarily moves through a fixed distance in its feed and return strokes. In the event that the longitudinal spacing of the indentations 14 varies or is slightly different than the fixed movement of the block 42, the amount of the variation can accumulate to the point where it exceeds the length of the indentation. This occurs because at the top of each return stroke the point 54 will engage the angled surface 16 wherever it happen to be and then will feed the strip from that position a fixed amount and then will return to the next indentation, which may be slightly further away than the fixed return stroke anticipates. So that each cycle causes the point 54 of the pawl 46 to engage the angled surface 16 further and further away from the center of the indentation 14. Eventually, the point 54 will no longer engage an indentation 14 and the feed mechanism will malfunction.

What is needed is a feed mechanism that will feed a strip of elongated products without the possibility of scratching or marring the outer surface of the product, and that will accurately feed a strip of elongated products having variations in the spacing of the indentations and wherein the spacing may be slightly different than the fixed stroke of the feed mechanism.

SUMMARY OF THE INVENTION

A machine is provided for receiving a continuous strip of elongated products mutually attached end to end. The machine includes a frame and is arranged for incrementally feeding the strip of products and performing a manufacturing operation therewith. Each two adjacent products are attached at an indentation. A feed mechanism is coupled to the frame of the machine for incrementally feeding the strip of products. The feed mechanism includes a feed track for closely receiving and guiding the strip of products along a first axis, and first and second feed fingers mutually opposed on opposite sides of the first axis. Means is provided for moving the first and second feed fingers toward the first axis until in feeding engagement with the strip of products without gripping the strip of products. Additionally, an actuator is included for moving the first and second feed fingers in a direction parallel to the first axis thereby feeding the strip of products along the first axis.

The feed mechanism further includes a drive carriage and a follower carriage coupled to the frame and arranged for independent sliding movement along the first axis. The feed track extends along the first axis through both the drive carriage and follower carriage. The first and second feed fingers are carried by the drive carriage and coupled to the follower carriage so that relative motion of the drive carriage toward the follower carriage in the feed direction causes the feed fingers to mutually move into feeding engagement with the strip of products for effecting the incremental feeding thereof without gripping the strip of products;

An embodiment of the invention will now be described by way of example with reference to the following drawings.

DESCRIPTION OF AN EMBODIMENT OF THE INVENTION

Figure 3:
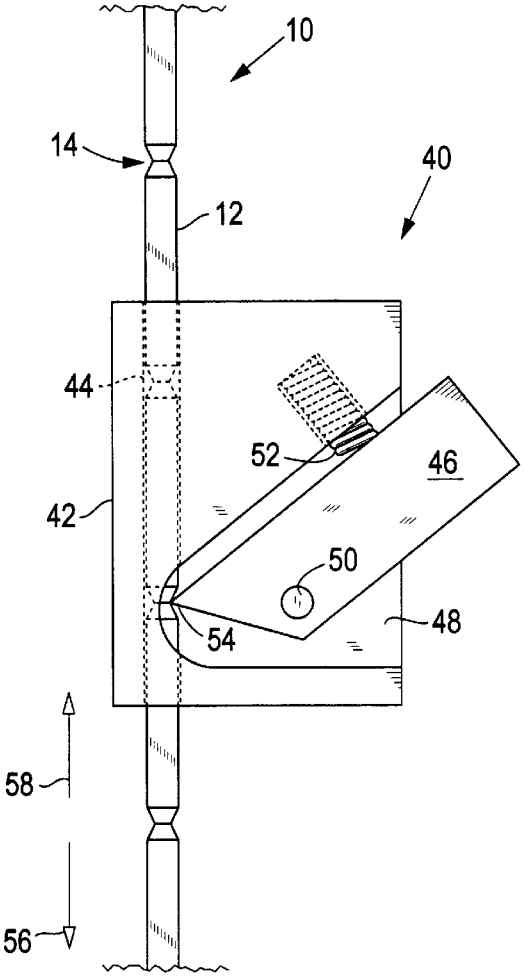
FIG. 3 PRIOR ART
FIG. 3 is a side view of a portion of a prior art feed mechanism for feeding a strip of pins.
Figure 1:
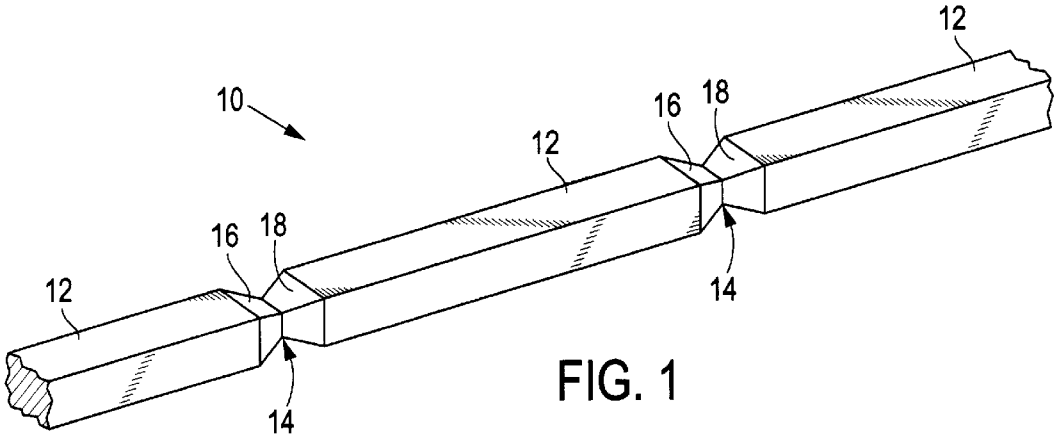
FIG. 1 is an isometric view of a portion of a strip of square pins.
Figure 2:
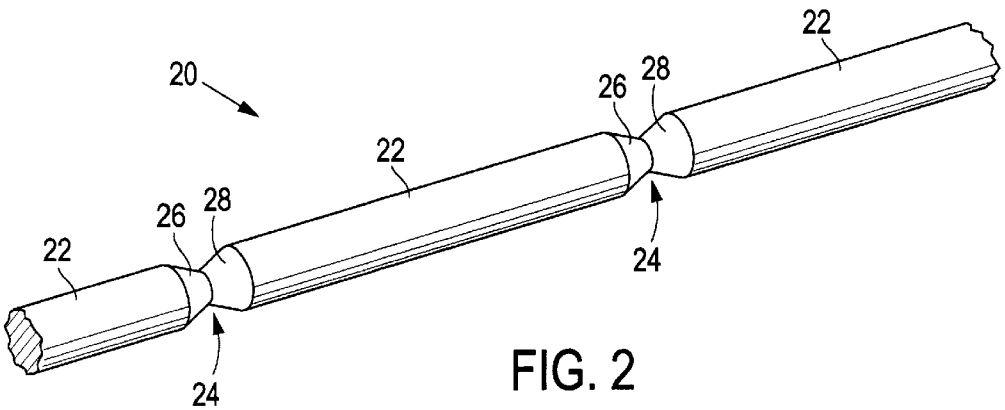
FIG. 2 is an isometric view of a portion of a strip of round pins.
Figure 4:
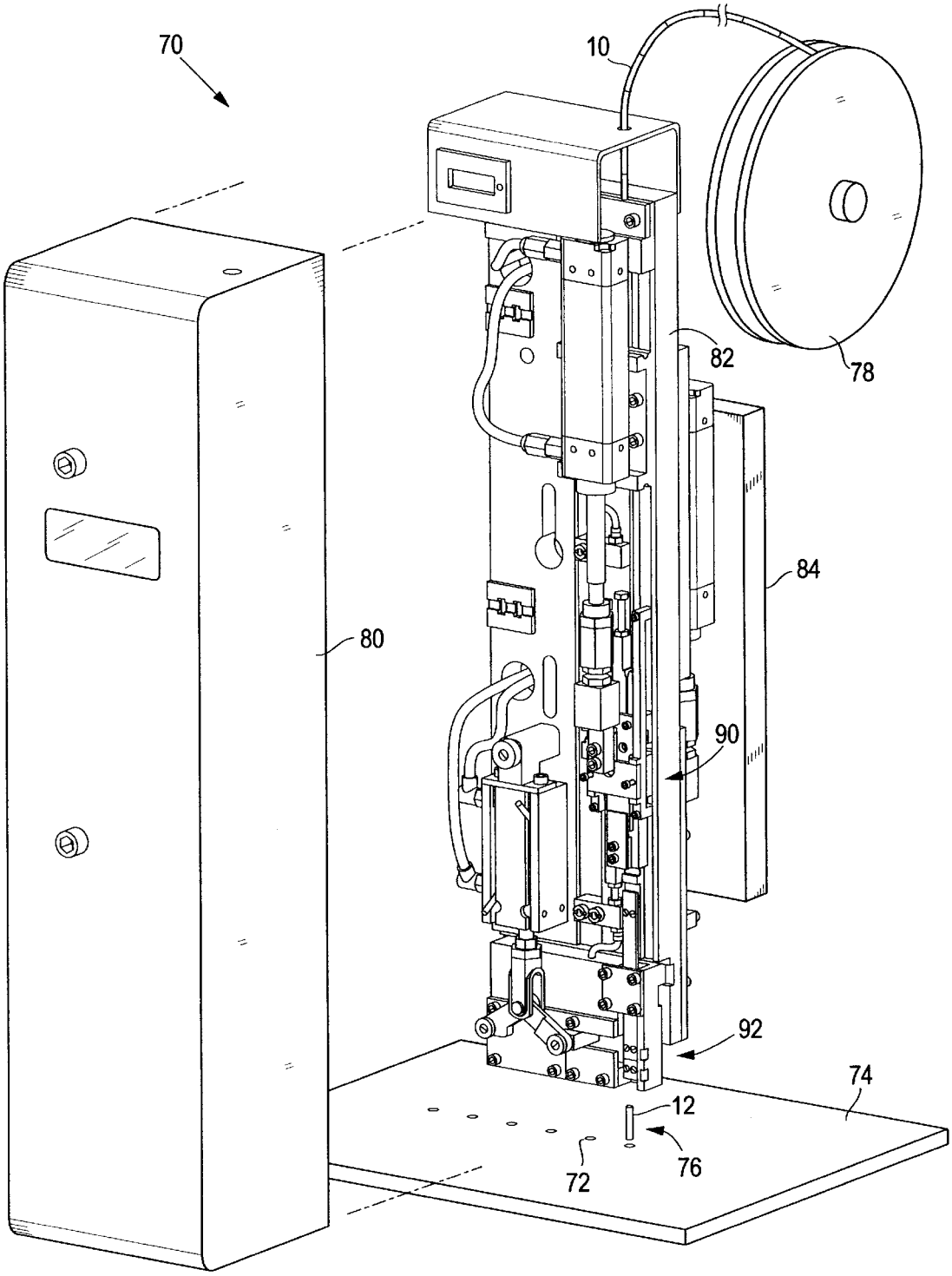
FIG. 4 is an isometric view of a pin insertion machine showing the cover removed, having a feed mechanism incorporating the teachings of the present invention.

There is shown in FIG. 4 a pin insertion machine 70 for receiving a strip 10 of mutually attached pins 12, and inserting the pins individually into holes 72 of a substrate 74, as shown at 76. The strip 10 is dereeled from a reel 78 in the usual manner. The insertion machine 70 includes an outer cover 80, a frame 82, various operational components mounted to the frame 82, and a mounting plate 84 for securing the insertion machine to a host machine that directs the placement of the pins 12 in the substrate. The various operational components include a feed mechanism 90 attached to the frame 82 for incrementally feeding the strip 10 of pins into a pin cutoff area 92 where each individual pin 12 is severed from the strip 10 preparatory to its insertion into the substrate.

Figure 5:
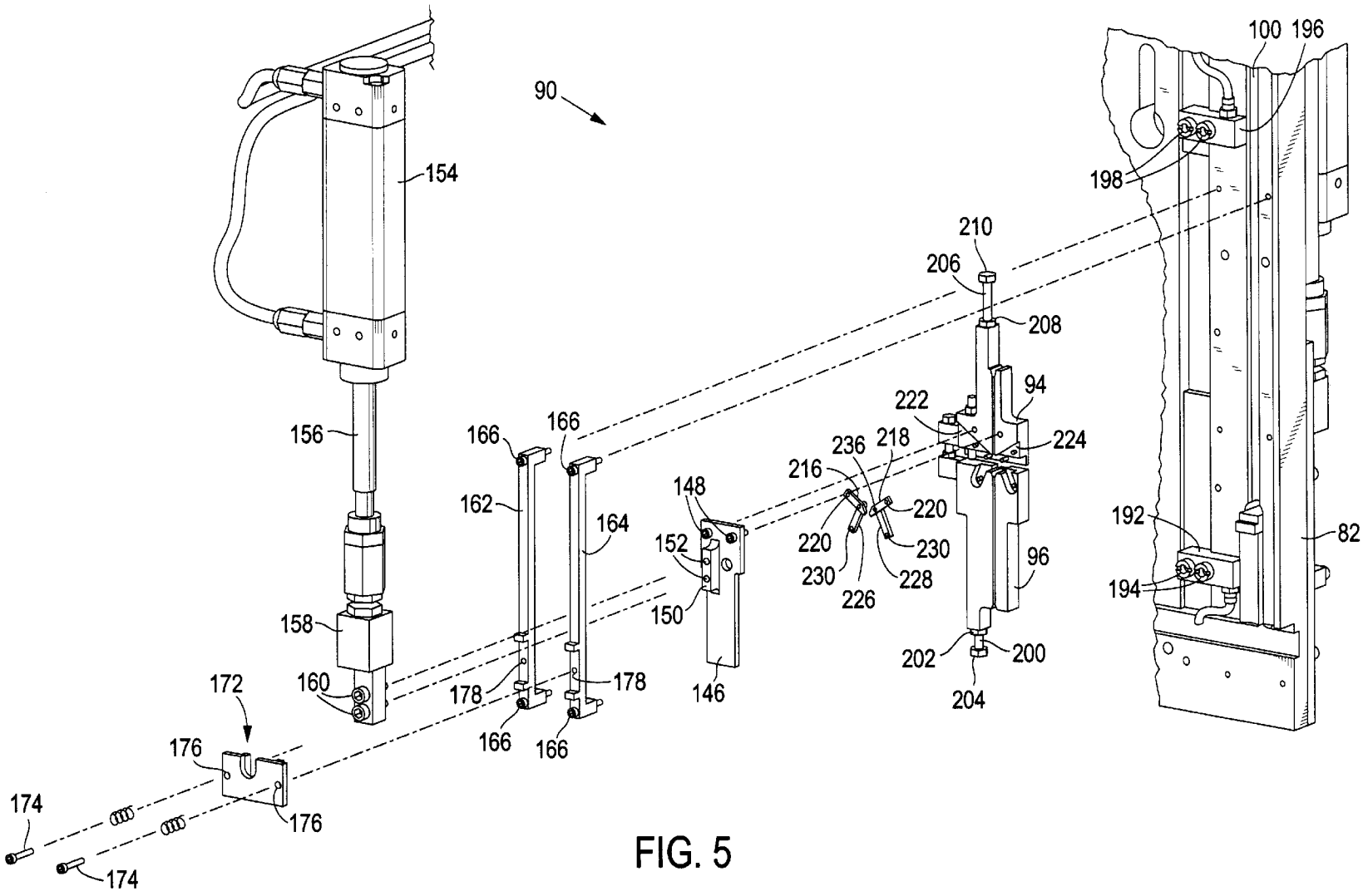
FIG. 5 is an exploded parts view of the feed mechanism shown in FIG. 4.
Figure 6:
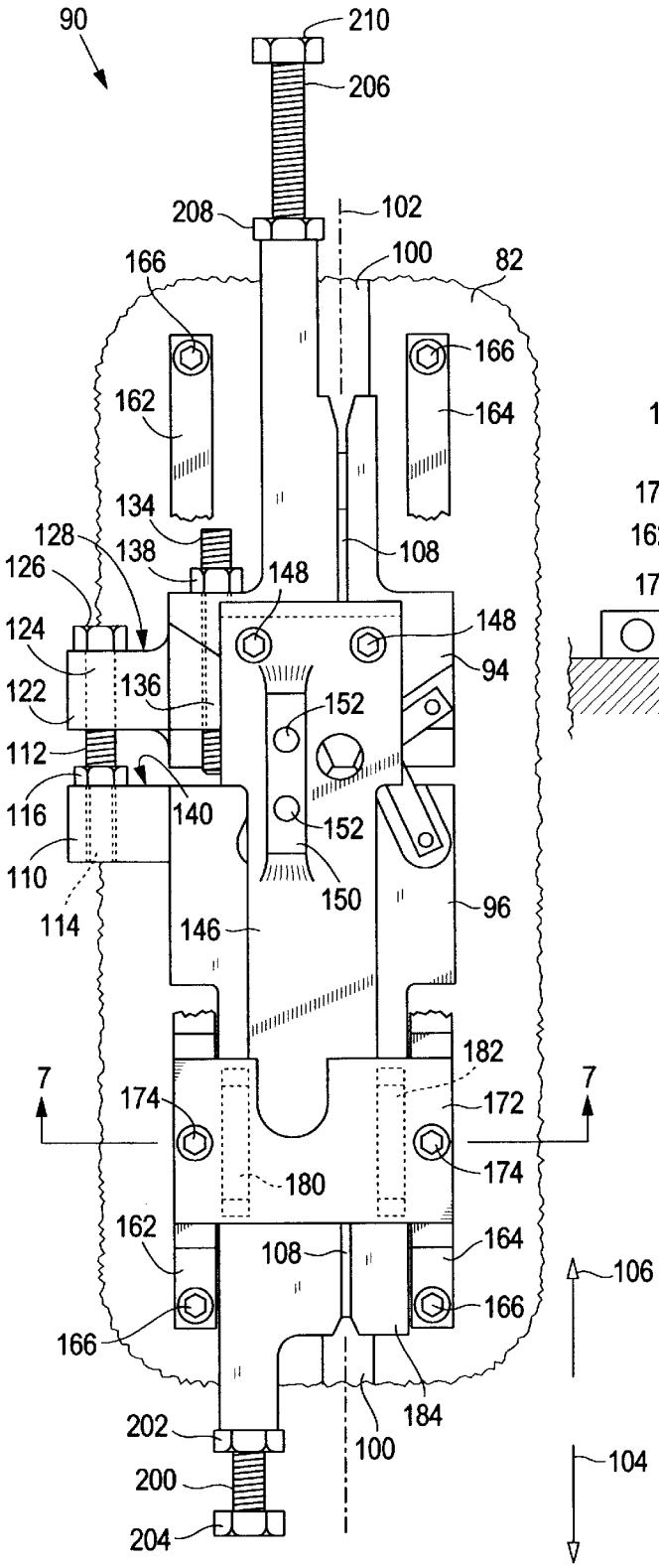
FIG. 6 is a plan view of the feed mechanism shown in FIG. 4.
Figure 7:
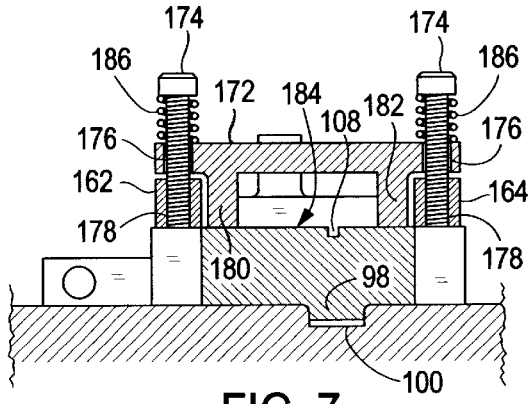
FIG. 7 is a cross-sectional view taken along the lines 7—7 in FIG. 6.

The feed mechanism 90, as best seen in FIGS. 5, 6, and 7, includes a drive carriage 94 and a follower carriage 96. Each of the carriages 94 and 96 includes a key 98 formed therein and projecting downwardly, as viewed in FIG. 7, into sliding engagement with a slot 100 formed in the surface of the frame 82, so that the drive carriage and the follower carriage are free to slide along a first axis 102 in a feed direction 104 and in an opposite return direction 106, indicated by arrows in FIG. 6. A feed track 108 is formed in the surfaces of the two carriages 94 and 96 in mutual alignment with the first axis and extending longitudinally for the length of both carriages. The feed track is sized to closely receive the strip 10 and to guide it during the feeding cycle along the first axis. The follower carriage 96 has a flange 110 extending outwardly to the left, as shown in FIG. 6, and includes a limit bolt or return stop 112 extending from a threaded hole 114 formed in the flange. A lock nut 116 is threaded onto the limit bolt 112 and is tightened against the flange 110 to secure the limit bolt 112 in place. Another flange 122 extends from the drive carriage 94 and includes a clearance hole 124 through which the limit bolt 112 extends. The limit bolt 112 includes a head 126 that abuts the upper surface 128 of the flange 114 thereby holding the drive carriage 94 and the follower carriage 96 mutually captive. A limit screw or drive stop 134 is threaded into a hole 136 in the drive carriage, as shown in FIG. 6, and includes a lock nut 138 that is tightened against the drive carriage to secure the limit screw in place. The limit screw extends completely through the drive carriage and into proximity to an abutting surface 140 of the follower carriage 96. The limit bolt 112 and the limit screw 134 are mutually positioned within their respective threaded holes so that the drive carriage and the follower carriage may undergo a small amount of independent sliding movement within the slot 100. When that small amount of independent sliding movement is exceeded, then the drive carriage and the follower carriage must move together as a single unit, as will be explained in more detail below.

A cover plate 146 is attached to the drive carriage 94 by means of screws 148 that are threaded into holes in the drive carriage. The cover plate serves to hold the strip 10 within the feed track 108 during operation. A drive lug 150 extends from the cover plate 146 and includes a pair of threaded holes 152 therein. A drive cylinder 154, as best seen in FIGS. 4 and 5, is secured to the frame 82 in the usual manner, and includes a piston rod 156 attached to a coupling 158 that is attached to the drive lug 150 by means of screws 160 threaded into the holes 152. The drive carriage 94 and the follower carriage 96 are held captive to the frame 82 by means of a pair of guide rails 162 and 164, as shown in FIGS. 5, 6, and 7. The guide rails 162 and 164 are spaced to allow free sliding movement of the two carriages along the first axis 102 without appreciable lateral play. The guide rails are attached to the frame 82 by means of screws 166 threaded into holes in the frame. A drag plate 172 is coupled to the two guide rails 162 and 164 by means of a pair of shoulder screws 174 which extend through clearance holes 176 in the drag plate and into threaded holes 178 in the guide rails. The drag plate 172, which functions as a carriage drag, includes a pair of skids 180 and 182 that bear against the upper surface 184 of the follower carriage 96 thereby providing a resistance to movement in both the feed and return directions 104 and 106. A pair of compression springs 186 extend around respective ones of the shoulder screws 174 and supply a force urging the drag plate 172 toward the follower carriage so that the skids 180 and 182 forcefully engage the surface 184. The resistance to movement provided by the drag plate 172 is sufficient to prevent extraneous vibrations as well as gravity from inadvertently moving the follower carriage along the first axis in the directions 104 and 106. The overall limit of movement of the drive and follower carriages 94 and 96 is controlled by a feed stop block 192 attached to the frame 82 by means of screws 194 and a return stop block 196 attached to the frame by means of screws 198, as best seen in FIG. 5.

The follower carriage 96 includes an adjustable stop bolt 200 threaded into a hole in the lower end of the follower carriage and a lock nut 202 to secure the stop bolt in place, as shown in FIG. 6. The stop bolt 200 includes a head 204 that abuttingly engages the feed stop block 192 at the end of the feed stroke, thereby limiting the length of the feed stroke of the mechanism. Similarly, the drive carriage 94 includes an adjustable stop bolt 206 threaded into a hole in the upper end of the drive carriage and a lock nut 208 to secure the stop bolt in place, as shown in FIG. 6. The stop bolt 206 includes a head 210 that abuttingly engages the return stop block 196 at the end of the return stroke, thereby limiting the length of the return stroke and defining the beginning of the feed stroke.

Figure 8:
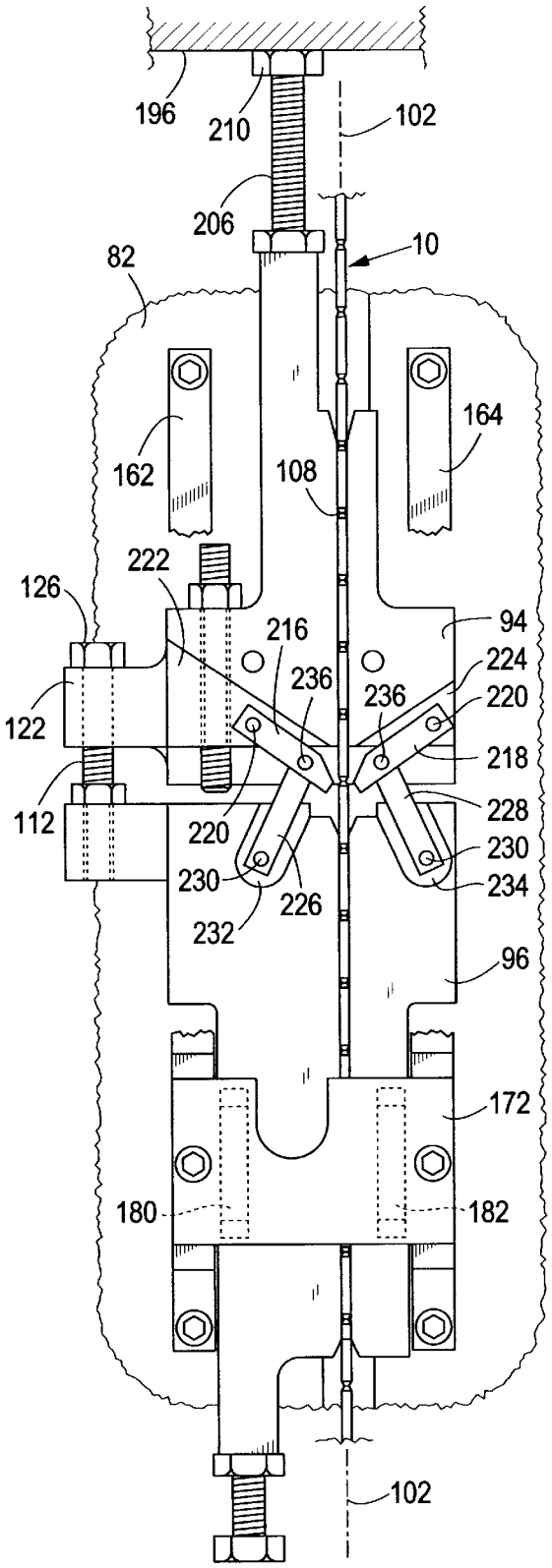
FIGS. 8, 9, 10, and 11 are views of the feed mechanism, similar to that of FIG. 6, showing the mechanism in various operating positions.
Figure 8A:
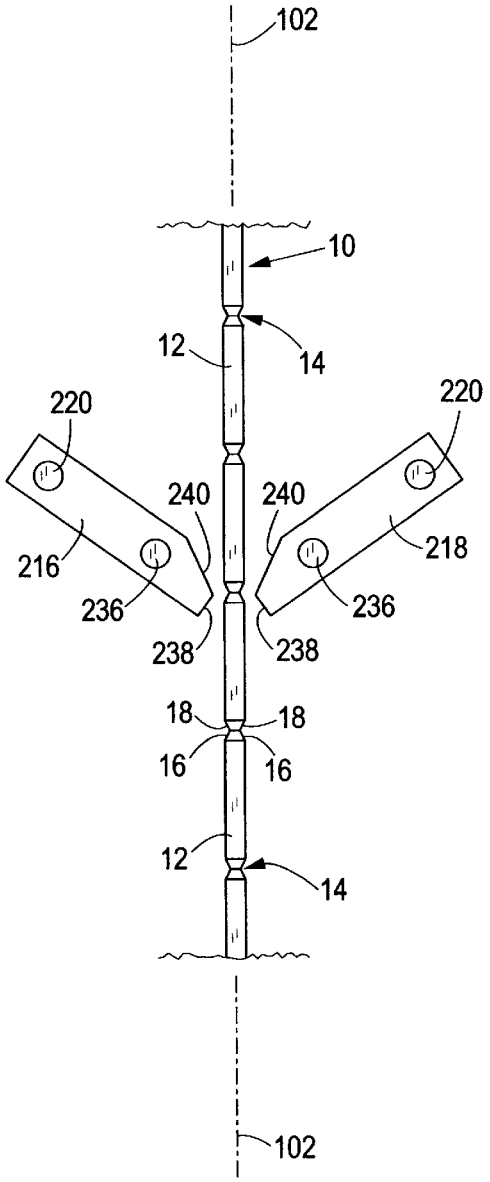
FIGS. 8A, 9A, 10A, and 11A are enlarged views of the feed fingers and strip of products as shown in corresponding FIGS. 8, 9, 10, and 11 respectively.

As shown in FIGS. 5 and 8 left and right feed fingers 216 and 218, respectively, have outward ends pivotally attached to the drive carriage by pivot pins 220, within cutouts 222 and 224 formed therein, the two feed fingers on opposite sides of the first axis 102. Left and right links 226 and 228 are, at one end, pivotally attached to the follower carriage by pivot pins 230, within cutouts 232 and 234 formed therein. The other end of each of the links 226 and 228, adjacent the first axis 102, is pivotally attached to an inward end of a respective feed finger 216, 218 by means of pivot pins 236. Each of the feed fingers 216 and 218 includes first and second angled surfaces 238 and 240 adjacent their inward ends, as best seen in FIGS. 8 and 8A. The first and second angled surfaces 238 and 240 substantially conform to the shape of the angled surfaces 16 and 18 of the indentation 14 in the strip 10, as shown in FIG. 8A. The left and right feed fingers are free to pivot about their respective pivot pins 220 as the drive carriage and the follower carriage undergo mutual relative movement along the first axis 102. Since the pivoting action of the two feed fingers is constrained by the action of the two links 226 and 228, as the drive carriage moves toward the follower carriage the angled surfaces 238 and 240 of the left and right feed fingers move toward the first axis 102, and as the drive carriage moves away from the follower carriage the angled surfaces 238 and 240 move away from the first axis. Importantly, the movement of the angled surfaces 238 and 240 toward and away from the first axis 102 is perpendicular to the first axis. This perpendicular movement results from the geometry of the left and right feed fingers 216 and 218 and the left and right links 226 and 228, and the positioning of the angled surfaces 238 and 240 relative to the pivot pins 220, 230, and 236. The distances between these pivot pins and the angled surfaces are selected so that this movement is perpendicular. The left and right feed fingers 216 and 218 and the left and right links 226 and 228 are loosely retained within their respective cutouts 222, 224, 232, and 234 by the cover plate 146.

Figure 9:
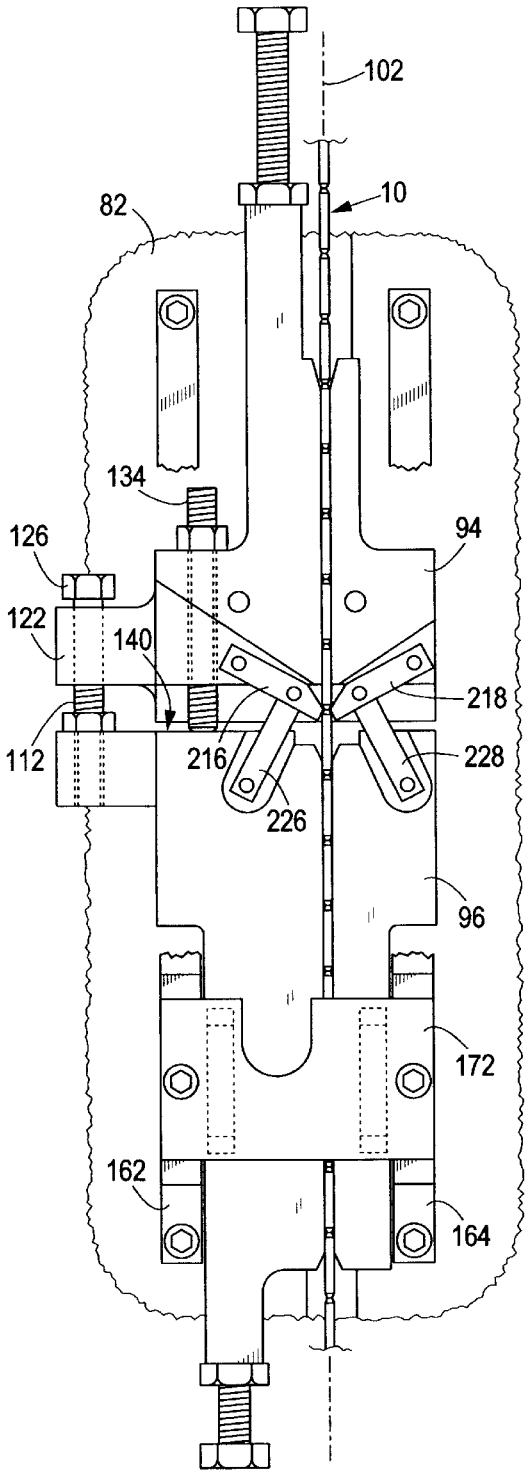
Figure 9A:
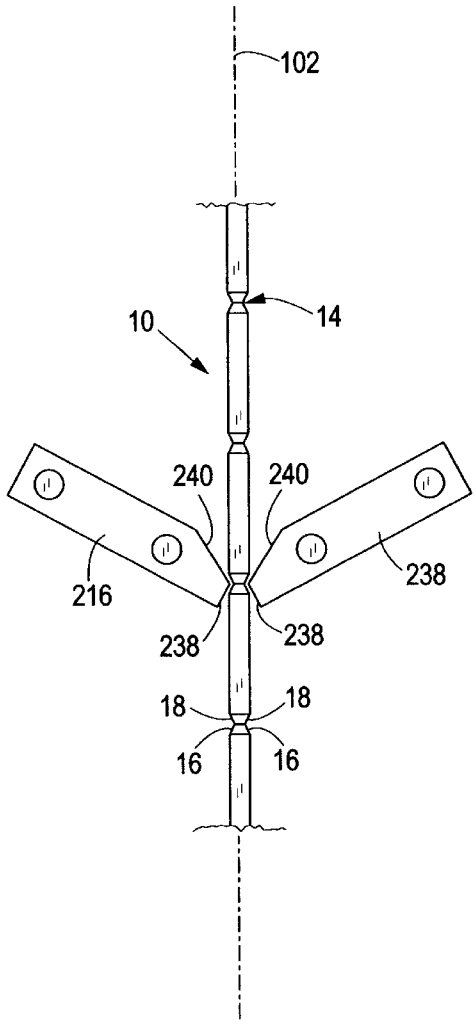
Figure 10:
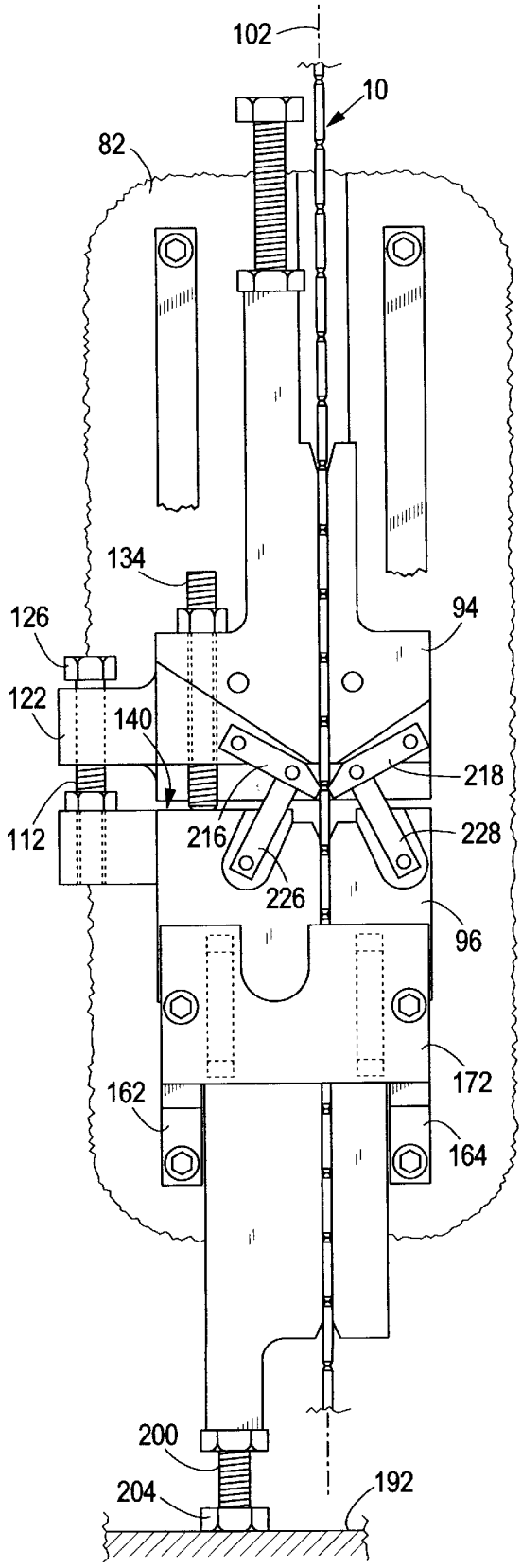
Figure 10A:
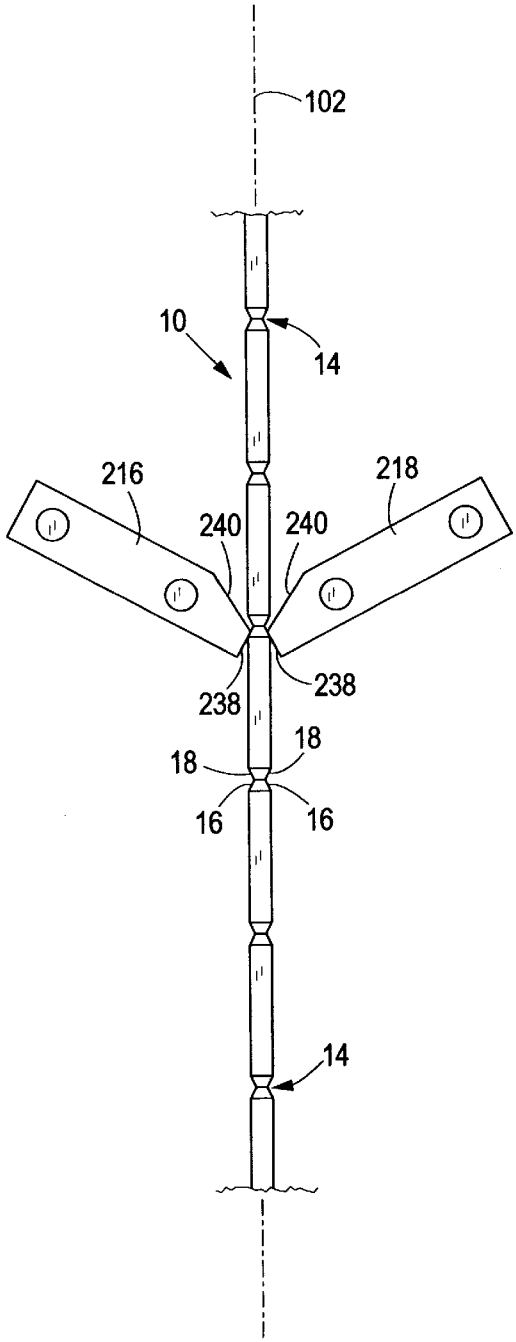
Figure 11:
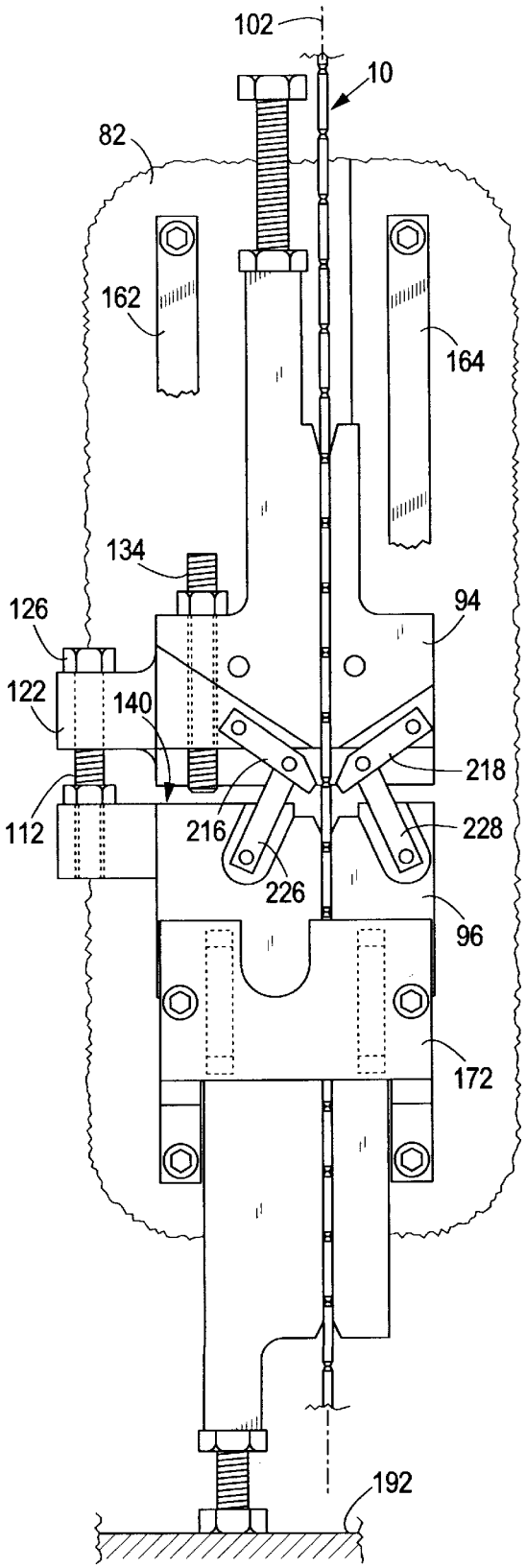
Figure 11A:
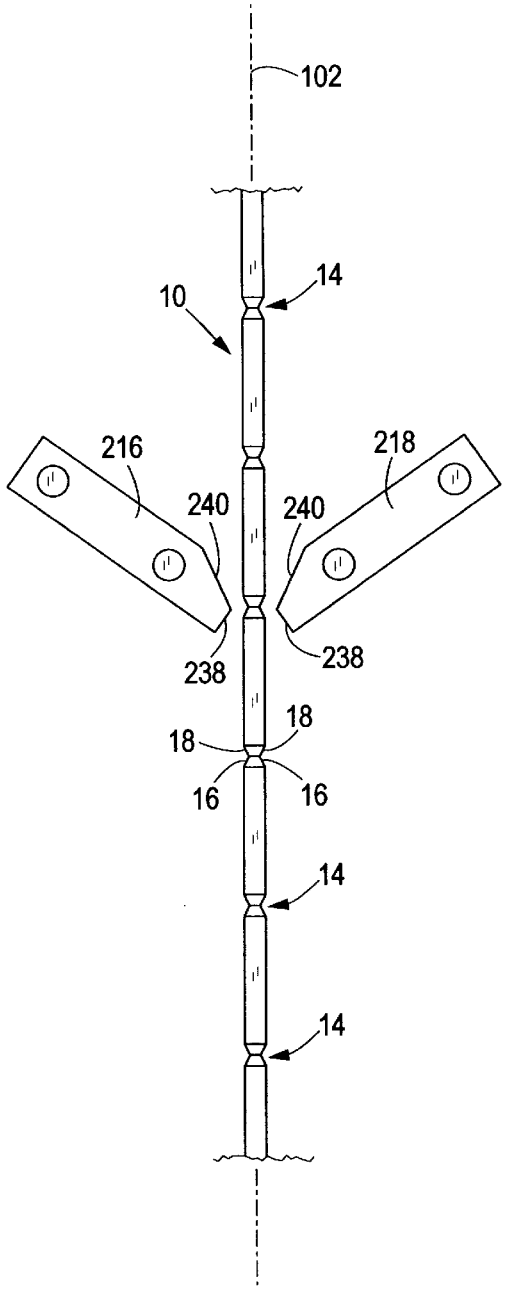

The operation of the feed mechanism of the present invention will now be described with reference to FIGS. 8 through 11A. As shown in FIG. 8, the drive carriage is completely retracted so that the head 210 of the stop bolt 206 is in engagement with the return stop block 196 and the head 126 of the bolt 112 is against the flange 122. The strip 10 of pins 12 is loaded into the feed track 108 so that one of the indentations 14 is in alignment with the angled surfaces 238 and 240 of the left and right feed fingers 216 and 218, as best seen in FIG. 8A. The pin insertion machine 70 includes a drag mechanism, not shown, that applies a resistance to movement to the strip 10 so that the strip remains in position with respect to the machine 70 unless moved by the feed fingers 216 and 218. To begin operation, the cylinder 154 is activated to extend the piston rod 156 thereby causing the drive carriage to move in the feed direction 104 toward the follower carriage 96, which remains stationary due to the resistance of the drag plate 172. This causes the left and right feed fingers 216 and 21 8 to pivot so that their angled surfaces 238 and 240 move toward the first axis 102 and into feeding engagement with the indentation 14 of the strip 10, as shown in FIG. 9A, just as the limit screw 134 abuts the surface 140 of the follower carriage 94, as shown in FIG. 9. At this point in the operating cycle it will be noted that, while the feed fingers 216 and 218 are in feeding engagement with the indentation 14, there is sufficient clearance between the angled surfaces 16 and 18 of the strip 10 and the angled surfaces 238 and 240 of the feed fingers so that the strip can be moved longitudinally a smallamount in the feed track 108. The limit screw 134 is adjusted within the hole 136 to accomplish this important clearance. As the piston rod 156 continues to move the drive carriage 94 in the feed direction 104, the limit screw 134 forces the follower carriage 96 to move in the feed direction as well. As this occurs, the angled surfaces 238 of the feed fingers engage the angled surfaces 16 of the indentation 14 thereby causing the strip 10 to move along with the drive carriage and follower carriage in the feed direction. Note that this movement does not cause the left and right feed fingers to pinch or close onto the indentation 14, however, the resistance against movement of the follower carriage 96 caused by the drag plate 172 assures that the feed fingers stay in feeding engagement with the indentation 14. This movement continues until the head 204 of the stop bolt 200 abuts the feed stop block 192, as shown in FIG. 10. At this point the strip 10 has been moved along the first axis for a distance equal to the length of one pin 12. If necessary, the stop bolt 200 is adjusted within the threaded hole in the follower carriage to assure that the length of the feed stroke substantially equals the length of one pin 12. At this point the insertion machine 70 removes the lowest pin 12 from the strip 10 and inserts it into the substrate 74. The cylinder 154 is activated to withdraw the piston rod 156 so that the drive carriage begins to move in the return direction 106. As this occurs the follower carriage 96 remains stationary due to the resistance to movement caused by the drag plate 172, and the feed fingers 216 and 218 pivot so that their respective angled surfaces 238 and 240 move away from the indentation 14. This is done without moving the strip 10 with respect to the insertion machine 70 because the angled surfaces 238 and 240 of the feed fingers withdraw in a direction perpendicular to the first axis 102 and, as stated above, the strip 10 is restrained from moving by a drag mechanism incorporated into the machine 70. As the drive carriage continues to move in the return direction 106 the head 126 of the bolt 112 abuts the surface 128 of the flange 122 so that the left and right feed fingers 216 and 218 are fully retracted from the indentation 14, as shown in FIGS. 11 and 11A. As movement continues the follower carriage now begins to move in the return direction while the strip 10 remains stationary with respect to the insertion machine 70. When the drive carriage and the follower carriage reach their respective fully retracted positions, shown in FIGS. 8 and 8A, the feed cycle can be repeated.

Importantly, the limit screw 134 and the bolt 112 are adjusted so that during the feed stroke the feed fingers do not pinch or close onto the strip 10 and during the return stroke the feed fingers completely disengage the strip 10 so that the feed fingers do not score or mar the outer surfaces of the strip 10. In the event that the length of the next pin 12 is slightly longer or shorter than the previous pin, the small clearance between the angled surfaces 238 and 240 of the feed fingers and the angled surfaces 16 and 18 of the indentation 14, as shown in FIG. 9A, will allow the feed fingers to properly engage the indentation. In this way a tolerance build up of the pins 12 within the strip 10 can be tolerated and cannot cause the present feed mechanism to jamb or misfeed.

An important advantage of the present invention is that small variations in pin length can be tolerated. The angled surfaces 238 and 240 are arranged to conform to the angled surfaces 16 and 18 of the indentation 14 and to move perpendicular to the pin 12 so that flat surface contact is assured, thereby eliminating slipping and gouging of the surfaces of the pin 12. Additionally, during the return stroke the feed fingers do not drag across the surface of the strip 10 and possibly damage the surfaces of the strip or the feed fingers. Another important advantage of the present invention is that the drag plate 172 applies sufficient resistance to movement of the follower carriage so that the feed fingers 216 and 218 are forced into feeding engagement with the indentation 14 and will not slip out of feeding engagement. Additionally, the length of the feed stroke need not be set as accurately as would otherwise be necessary with prior art feed mechanisms due to this small amount of clearance between the angled surfaces 16, 18 and 238, 240.

What is claimed is:

1. In a machine for receiving a continuous strip of rectangularly-shaped products mutually attached end to end, each two adjacent products being attached at an indentation, said machine having a frame and arranged for incrementally feeding said strip of products and performing a manufacturing operation therewith, a feed mechanism coupled to said frame for effecting the incremental feeding of said strip of products comprising:

(1) a feed track for closely receiving and guiding said strip of products along a first axis;

(2) first and second feed fingers mutually opposed on opposite sides of said first axis:

(3) lateral means for moving said first and second feed fingers toward said first axis until in feeding engagement with said strip of products without gripping said strip of products; and (4) an actuator for moving said first and second feed fingers in a feed direction parallel to said first axis thereby feeding said strip of products along said first axis.

2. The feed mechanism according to claim 1 wherein each indentation is formed by angular surfaces on at least one of said two adjacent products and wherein each said feed finger includes an angled feed surface adjacent said first axis, so that when said first and second feed fingers are in feeding engagement with said strip of products:

(1) portions of said angled feed surfaces of said first and second feed fingers are positioned within the indentation of said strip of products so that said strip of products is movable a small amount along said first axis while said first and second feed fingers are stationary and (2) when said actuator effects moving of said first and second feed fingers, at least one of said angled feed surfaces engages said angular surface of the indentation and effects the feeding of said strip of products along said first axis.

3. The feed mechanism according to claim 2 including a drive carriage and a follower carriage both of which are coupled to said frame and arranged for sliding movement along said first axis in the feed direction and an opposite return direction, said feed track extending through both said drive carriage and said follower carriage, wherein each of said first and second feed fingers includes an inward end adjacent said angled feed surface thereof and an opposite outward end pivotally attached to said drive carriage on a respective side of said first axis, said lateral means including first and second links on opposite sides of said first axis, said first link having one end pivotally attached to said inner end of said first feed finger and another end pivotally attached to said follower carriage, and said second link having one end pivotally attached said inner end of said second feed finger and another end pivotally attached to said follower carriage.

4. The feed mechanism according to claim 3 including:

(1) a drive stop attached to said drive carriage arranged to abut said follower carriage when said drive carriage is caused to undergo sliding movement in said feed direction thereby causing said follower carriage to also move in said feed direction and (2) a return stop attached to said follower carriage arranged to engage said drive carriage when said drive carriage is caused to undergo sliding movement in said return direction thereby causing said follower carriage to also move in said return direction, wherein said actuator is a linear actuator attached to said frame and arranged to cause sliding movement of said drive carriage along said first axis.

5. The feed mechanism according to claim 4 wherein said drive stop is adjustably attached to said drive carriage and arranged so that when said linear actuator causes said drive carriage to undergo sliding movement in said feed direction, said drive carriage moves a finite first distance toward said follower carriage until said drive stop engages said follower carriage, wherein sliding movement in said feed direction causes said angled feed surfaces of said first and second feed fingers to mutually move toward said first axis and into feeding engagement with said strip of products.

6. The feed mechanism according to claim 5 wherein said return stop is adjustably attached to said follower carriage and arranged so that when said linear actuator causes said drive carriage to undergo sliding movement in said return direction, said drive carriage moves a finite second distance away from said follower carriage until said return stop engages said drive carriage, wherein sliding movement in said return direction causes said angled feed surfaces of said first and second feed fingers to mutually move away from said first axis and out of feeding engagement with said strip of products.

7. The feed mechanism according to claim 6 wherein said finite first distance equals said finite second distance.

8. The feed mechanism according to claim 7 including a carriage drag coupled to said frame and arranged to cause said follower carriage to resist undergoing sliding movement along said first axis until a minimum force is applied through one of either said feed stop and said return stop to said follower carriage to overcome the resistance and cause said follower carriage to undergo sliding movement along said first axis.

9. The feed mechanism according to claim 6 wherein said return stop is adjustable so that when said angled feed surfaces of said first and second feed fingers mutually move out of feeding engagement with said strip of products, said first and second feed fingers are spaced from said strip of products during all of the movement of said follower carriage in said return direction.

10. In a machine for receiving a continuous strip of rectangularly-shaped products mutually attached end to end, each two adjacent products being attached at an indentation, said machine having a frame and arranged for incrementally feeding said strip of products and performing a manufacturing operation therewith, a feed mechanism coupled to said frame for effecting incremental feeding of said strip of products comprising:

(1) a drive carriage and a follower carriage coupled to said frame and arranged for independent sliding movement along a first axis in a feed direction and an opposite return direction;

(2) first and second feed fingers carried by said drive carriage and coupled to said follower carriage so that relative motion of said drive carriage toward said follower carriage in said feed direction causes said feed fingers to mutually move into feeding engagement with said strip of products for effecting incremental feeding thereof without gripping said strip of products; and (3) an actuator for effecting sliding movement of said drive carriage and said follower carriage.

11. The machine according to claim 10 wherein said first and second feed fingers are pivotally attached to said drive carriage and said coupling of said first and second feed fingers to said follower carriage comprises two links, one of said links has one end pivotally attached to said follower carriage on one side of said first axis and another end pivotally attached to said first feed finger, and another of said links has one end pivotally attached to said follower carriage on an opposite side of said first axis and another end pivotally attached to said second feed finger.

12. The machine according to claim 11 wherein each said indentation is formed by angular surfaces on at least one of said two adjacent products and wherein each said first and second feed finger includes an angled feed surface adjacent said first axis, so that when said first and second feed fingers are in feeding engagement with said strip of products:

(1) portions of said angled feed surfaces of said first and second feed fingers are positioned within the indentation of said strip of products so that said strip of products is movable a small amount along said first axis while said first and second feed fingers are stationary and (2) when said drive carriage effects moving of said first and second feed fingers, at least one of said angled feed surfaces engages the angular surface of the indentation and effects feeding of said strip of products along said first axis.

13. The machine according to claim 12 wherein each of said first and second feed fingers includes an inward end adjacent said angled feed surface thereof and an opposite outward end adjacent said pivotal attachment to said drive carriage, and wherein said pivotal attachment of one said link to said first feed finger is effected at said inward end thereof, and said pivotal attachment of the other said link to said second feed finger is effected at said inward end thereof.

14. The feed mechanism according to claim 13 including:

(1) a drive stop attached to said drive carriage arranged to abut said follower carriage when said drive carriage is caused to undergo sliding movement in said feed direction thereby causing said follower carriage to move in said feed direction and (2) a return stop attached to said follower carriage arranged to engage said drive carriage when said drive carriage is caused to undergo sliding movement in said return direction thereby causing said follower carriage to move in said return direction.

15. The feed mechanism according to claim 14 wherein said drive stop is adjustably attached to said drive carriage and arranged so that when said actuator causes said drive carriage to undergo sliding movement in said feed direction, said drive carriage moves a finite first distance toward said follower carriage until said drive stop engages said follower carriage, wherein movement in said feed direction causes said angled feed surfaces of said first and second feed fingers to mutually move toward said first axis and into feeding engagement with said strip of products.

16. The feed mechanism according to claim 15 wherein said return stop is adjustably attached to said follower carriage and arranged so that when said actuator causes said drive carriage to undergo sliding movement in said return direction said drive carriage moves a finite second distance away from said follower carriage until said return stop engages said drive carriage, wherein movement in said return direction causes said angled feed surfaces of said first and second feed fingers to mutually move away from said first axis and out of feeding engagement with said strip of products.

17. The feed mechanism according to claim 16 wherein said finite first distance equals said finite second distance.

18. The feed mechanism according to claim 17 including a carriage drag coupled to said frame and arranged to cause said follower carriage to resist undergoing sliding movement along said first axis until a minimum force is applied through one of either said feed stop and said return stop to said follower carriage to overcome the resistance and cause said follower carriage to undergo sliding movement along said first axis.

19. The feed mechanism according to claim 16 wherein said return stop is adjustable so that when said angled feed surfaces of said first and second feed fingers mutually move out of feeding engagement with said strip of products, said first and second feed fingers are spaced from said strip of products during all of the movement of said follower carriage in said return direction.

20. The machine according to claim 10 wherein movement of said feed fingers into feeding engagement is movement perpendicular to said first axis.

* * * * *